United States Patent [19]

Goodnight et al.

[11] 4,237,858

[45] Dec. 9, 1980

[54] THIN AND FLAT FLAME BURNER

[75] Inventors: Hershel E. Goodnight; Kurt S. Jaeger; Richard R. Martin, all of Tulsa, Okla.

[73] Assignee: John Zink Company, Tulsa, Okla.

[21] Appl. No.: 869,712

[22] Filed: Jan. 16, 1978

[51] Int. Cl.[3] ..... F24H 1/20; F23D 15/02; F24H 1/00

[52] U.S. Cl. ..... 126/360 R; 431/352; 432/222

[58] Field of Search ..... 126/360 A, 360 R; 432/222; 431/349, 350, 351, 353

[56] References Cited

U.S. PATENT DOCUMENTS

| | | | |
|---|---|---|---|
| 3,044,754 | 7/1962 | Skerkoske | 432/222 |
| 3,186,697 | 6/1965 | Haedike | 432/222 |
| 3,269,385 | 4/1966 | Mitchell | 126/360 A |
| 3,575,543 | 4/1971 | Weatherston | 431/349 |
| 3,649,211 | 1/1968 | Vosper | 431/350 |
| 3,732,059 | 5/1973 | Goodnight | 431/286 |
| 3,838,652 | 10/1974 | Schol | 432/222 |

FOREIGN PATENT DOCUMENTS

| | | | |
|---|---|---|---|
| 2042699 | 7/1971 | Fed. Rep. of Germany | 126/360 |
| 2307102 | 4/1976 | Fed. Rep. of Germany | 431/352 |
| 1001370 | 3/1971 | France | 126/360 |
| 6402379 | 1/1964 | Netherlands | 431/352 |
| 1420353 | 5/1957 | United Kingdom | 431/350 |

OTHER PUBLICATIONS

Trans. of the Inst. of Chem. Engr., vol. 27, 1949 N. Swindin: "Recent Developments in Submerged Combustion", pp. 209–219.

*Primary Examiner*—Samuel Scott
*Assistant Examiner*—G. A. Anderson
*Attorney, Agent, or Firm*—Head & Johnson

[57] ABSTRACT

A gas burner system for providing a thin, flat flame for use in a long narrow combustion space, has a first air supply plenum which has a long narrow rectangular cross-section, which is placed above a second plenum or combustion chamber of substantially the same cross-section. At the junction between the first and second plena there are longitudinal projections inwardly from both long walls of the second plenum, forming a long narrow rectangular inlet to the second plenum. A burner assembly comprising an elongated flattened pipe having a plurality of short air baffles welded on each side is supported in this narrow inlet to the second plenum and substantially in the center thereof. The overall width of the burner assembly is less than that of the inlet so that there are two longitudinal gaps between the burner assembly and the projections for the passage of combustion air. There are two sets of ports in the lower edge of the flattened pipe. A first set provides downstreamwardly and outwardly projecting ports for the passage of the major gas flow. A second set of smaller gas ports are drilled substantially laterally to the vertical, and the gas therefrom flows into the space behind the air baffles where a stable, sheltered flame can be provided, for continuous ignition of the major flow of gas issuing at high velocity from the first set of ports, and turbulently mixing with the air flow downwardly through the gaps. The walls of the second plenum and projections can be of conventional refractory material, or they can be of metal which is water cooled.

3 Claims, 6 Drawing Figures

THIN AND FLAT FLAME BURNER

BACKGROUND OF THE INVENTION

1. Field of the Invention

This invention lies in the field of large flow gas burners, of such size as to provide heat in the order of magnitude greater than 10,000,000 btu/hr when burning gas fuel at greater than 16 oz. pressure. More particularly, it is concerned with burners in which the combustion chamber is long and narrow in cross-section, and may have considerable height.

2. Description of the Prior Art

In the art of fuel-gas firing, where gas fuel pressure is less than 16 ounces, and where the heat released is less than 10,000,000 btu/hr, there is ample prior art. No new art is to be expected if the flame is to take the shape of an elongated flat, thin, sheet at its base, and the flow of fuel/air is of this magnitude or less.

However, if the release of heat is to be greatly in excess of 10,000,000 btu/hr., flame stability becomes questionable, because of the increased gas and air flow velocities. There is, to the best of knowledge, no prior art to permit heat release as great as 10,000,000 btu/hr. in such gas-firing systems.

In the art which is now to be disclosed there is no upper limit for heat release or gas/air flow velocities in the production of stable flames which are flat and thin as well as elongated.

Long flames in the form of wide thin sheets are, at times, required for distribution of heat to a space which is long and narrow as well as elongated. Flame length or the distance downstream from the flame base provides for the elongation, and flame thinness compensates for the narrowness of the combustion volume.

SUMMARY OF THE INVENTION

It is a primary object of this invention to provide a burner system for providing a thin flat flame for use in a long narrow combustion space.

It is a further object of this invention to provide a burner system to provide heat greatly in excess of 10,000,000 btu per hour with a stable flame.

This invention provides a type of burner system that can be used in confined narrow long combustion spaces such as for use, for example, in submerged combustion systems. In this case, the flame is directed downwardly within a combustion chamber lined by metal surfaces, and the combustion products pass downwardly under the bottom edge of the walls, and up through the water behind the walls to a collecting plenum at the top of the water surface. While this type of burner system has many uses and the construction can be varied to provide for refractory wall covering, it can also be used with metal surfaces which are water cooled, such as would be the case in submerged burner operations.

These and other objects are realized and the limitations of the prior art are overcome in this invention by providing two plena; a first plenum for supply of combustion air. This is rectangular in cross-section having a length much greater than its width. This is attached to a continuous second plenum of substantially the same rectangular cross-section, or slightly larger, that has a pair of projections inwardly along the long walls of the plenum so as to provide a narrow long rectangular inlet into the second plenum near the junction between the first and second plena.

While this invention can be used in many types of combustion systems, it will, for convenience, be described in connection with its use in submerged combustion systems. In such cases, the walls of the second plenum, and projections, which are in contact with flame, are made of metal, cooled by water on the back surface of the walls.

An elongated burner assembly comprises an elongated pipe, which, for convenience in providing the gas ports, has been flattened to an oval shape, and is supported with its long axis horizontal and with the principal axis of the oval in a vertical plane. A plurality of substantially horizontal air baffles are attached to each side of the pipe. The width of the overall assembly of pipe plus baffles on each side, is narrower than the width of the elongated opening between the two inward projections at the inlet to the second plenum. Thus, when the burner assembly is mounted axially therein, there will be long narrow gaps along each side of the burner, between the edges of the baffles and the inner surfaces of the projections. The width of these gaps may be of the order of one half to five eighths of an inch, or more, depending on the magnitude of gas flow, etc. It may be desirable also to provide a plurality of openings through the air baffles to provide additional flow of combustion air from the first plenum to the second plenum.

Adequate air supply under suitable pressure is provided into the first plenum, which then flows into the second plenum, or combustion chamber, through the longitudinal gaps, and through the openings in the air baffles.

The air pressure in the first plenum, P1, must be greater than the pressure P2 in the combustion chamber, which is the second plenum, in order to force adequate supply of air into the second plenum.

Furthermore, the pressure P2 of the flame and combustion products in the second plenum must be greater than the head of water behind the walls of the second plenum, so that the flow of these products of combustion can continue down under the bottom edge of the walls, and up through the water in the space behind the walls, of the second plenum. The second plenum, is, of course, immersed in a much larger volume of water, to a selected depth, and means are provided above the surface of the water around the second plenum to collect the products of combustion, including the steam formed by evaporation of water due to the passage of the hot combustion gases through it.

A plurality of pairs of ports are drilled in the bottom edge of the burner gas pipe. These are placed one on each side of the vertical axial plane and are set at an angle slightly downwardly and outwardly from the vertical. Most of the gas supply flows through these ports.

There is also a second series of ports of smaller cross-section, which are directed substantially outwardly from the pipe into the space immediately downstream of the air baffles. This small flow of gas into the quiet space behind the baffles formed a stable flame, which is not extinguished by the turbulent flow of air and gas downstream. This stable flame serves to continuously ignite the gas issuing from the pipe through the first set of ports, which turbulently mixes with the combustion air passing down through the longitudinal gaps and perforations through the air baffles. Thus, a stable high capacity flame is provided, flowing downwardly along the elevated second plenum in contact with the walls of the plenum. Because of the continual ignition of this main flame, from the igniting flame, due to the second set of ports, this invention permits very large capacity burners, without regard for air and fuel gas flow velocities, while still providing a stable flame.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
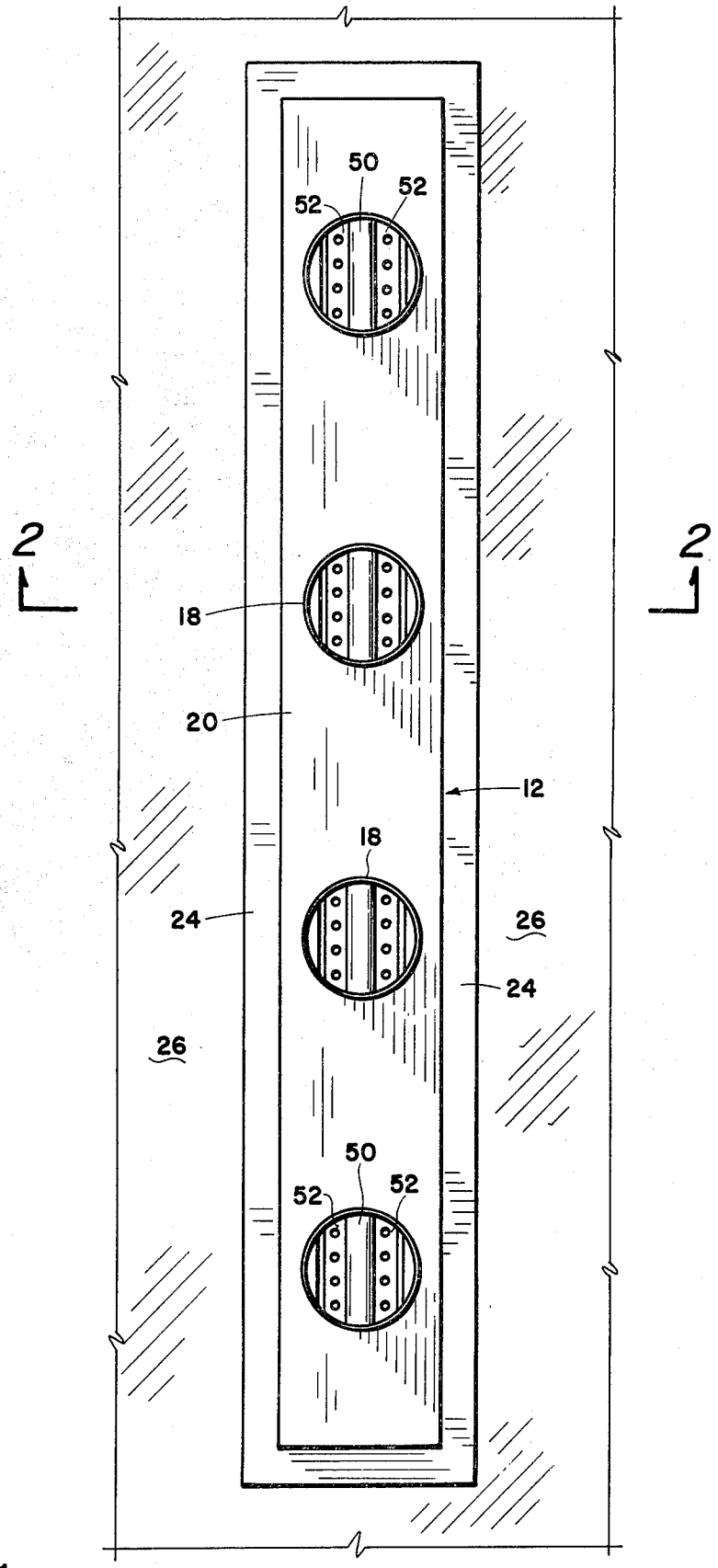
FIG. 1 represents a plan view of the assembly from a point above the first plenum.
Figure 2:
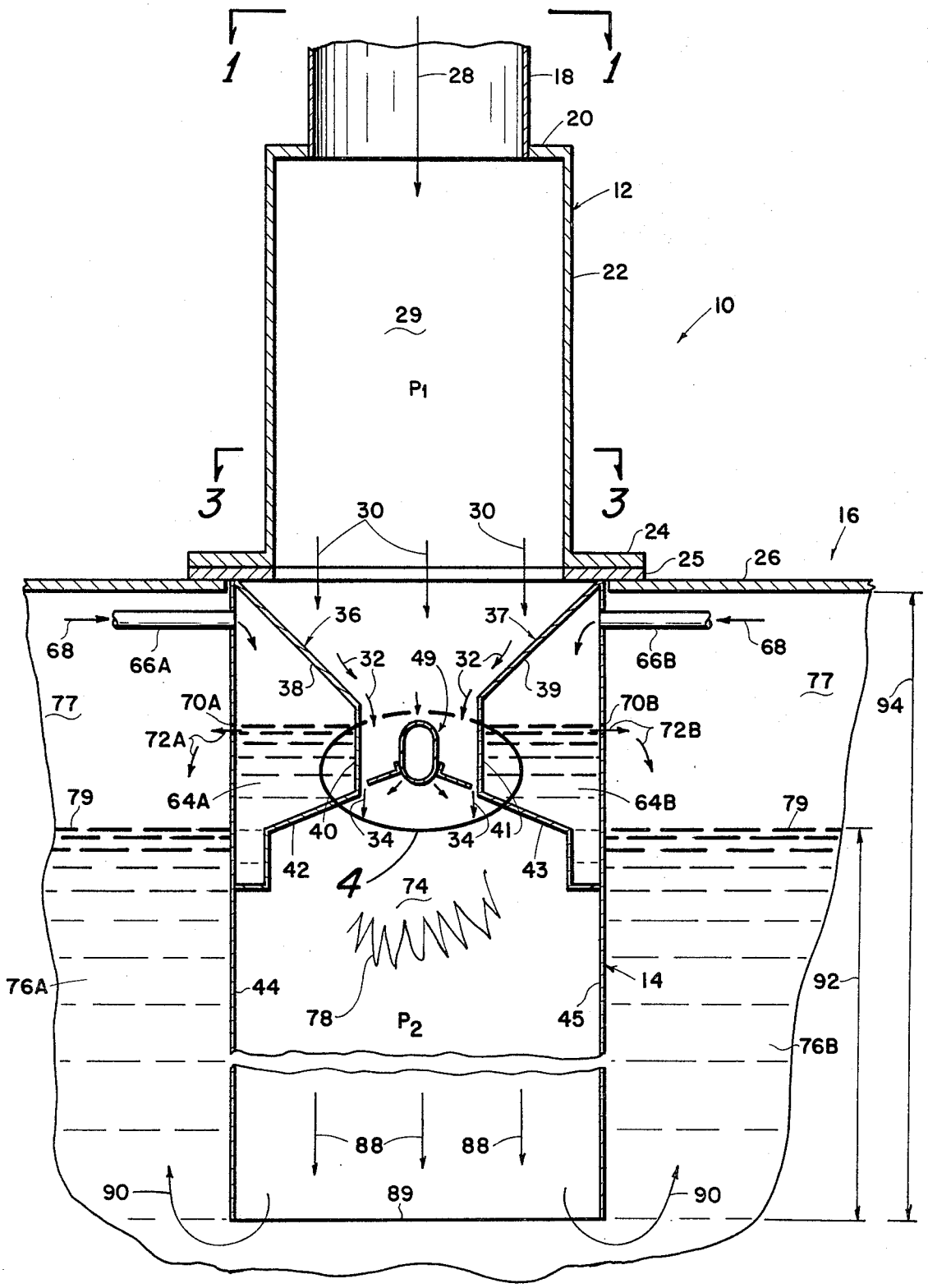
FIG. 2 represents a vertical sectional view through the burner assembly taken along the plane 2—2 of FIG. 1.
Figure 3:
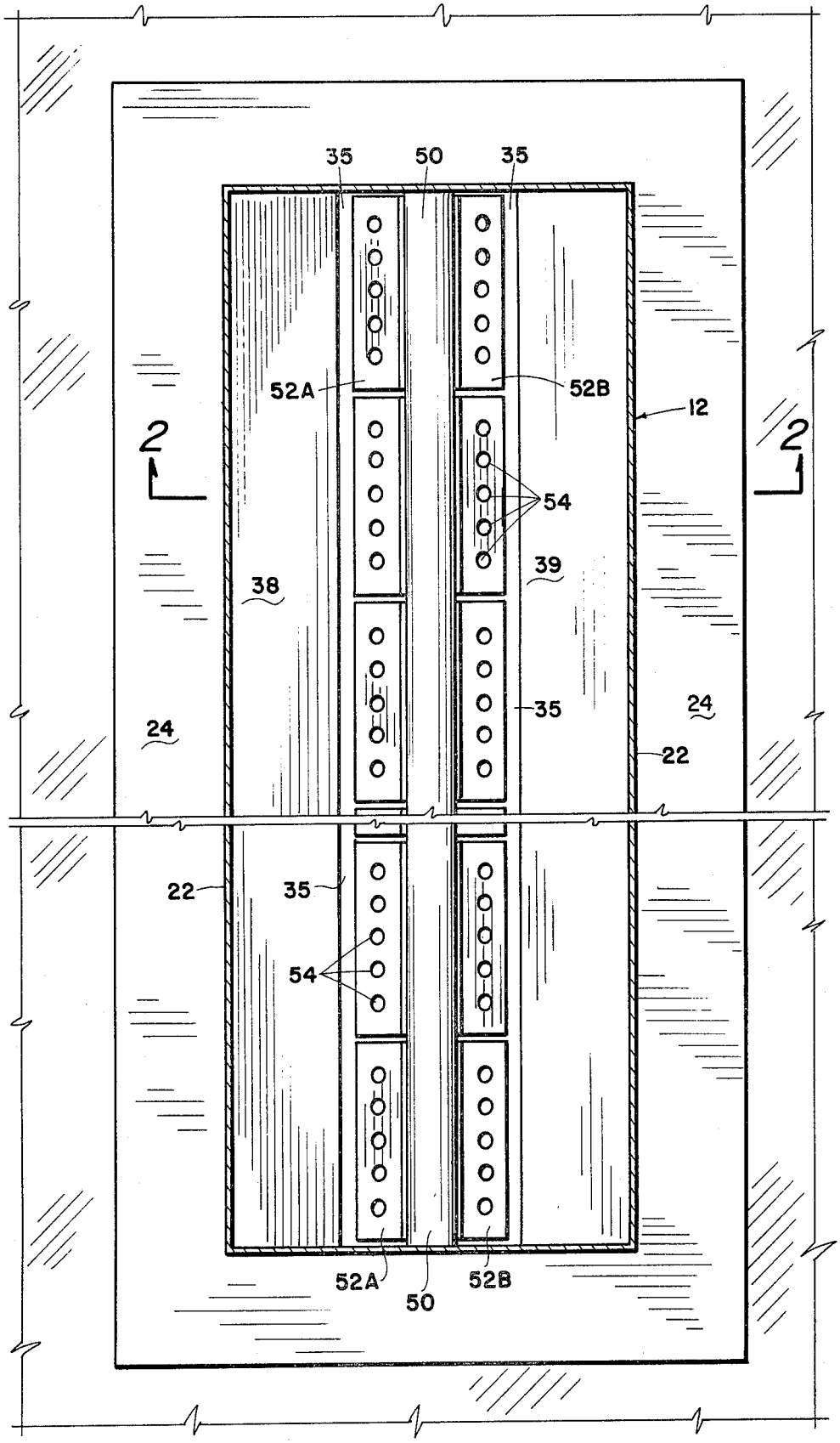
FIG. 3 represents a cross-section taken through the first plenum along the plane 3—3 of FIG. 2.

Referring now to the drawings and, in particular, to FIGS. 1, 2, and 3, there are shown several views of one embodiment of this invention. Starting with FIG. 2, which is a vertical cross-section taken across the length of the burner indicated by plane 2—2 of FIG. 1, there is indicated by numeral 10 the burner system of this invention. As explained previously, for convenience this invention will be described in terms of a vertically oriented burner system with the flame directed downwardly for utilization in a submerged combustion system.

There are several parts to the system, a first plenum indicated generally by the numeral 12, a second plenum indicated generally by the numeral 14, which is positioned under and contiguous to the first plenum. Numeral 16 indicates generally the combustion and utilization system applying this invention to a submerged burner system.

The first, or air plenum 12 comprises a box having a rectangular cross-section having sidewalls 22 and top 20 where the length of the top 20 is much greater than the width. As shown in FIG. 1, there is a plurality of vertical pipes 18, which are supplied with air under suitable pressure, in accordance with arrows 28. The pressure P1 in the space 29 within the plenum 12 is a selected value, as will be described later.

The first plenum 12 is open on the bottom and is attached by flanges 24 to a plate 26 which forms the top of the combustion system.

The second plenum, or combustion chamber 14, is of rectangular cross-section in a horizontal plane, which is of the same order of magnitude in length and width as that of the first plenum, although it is preferred to make it larger, as indicated in the drawing. There are vertical walls 44 and 45 to the second plenum of a selected total length 94 depending downwardly from the flange 25 by means of which it is supported on the plate 26 and attached to the first plenum 12.

The view of FIG. 2 is taken perpendicular to the length of the combustion zone or second plenum 14. At the inlet end of the second plenum there are two longitudinal inwardly-directed projections 36 and 37, respectively. These have cross-sectional shapes, which include upstream sloping surfaces 38, 39, vertical portions 40, 41, and outwardly expanding walls 42, 43 for attachment to the walls 44 and 45, respectively. These projections are indicated as being made of metal plates in the shape illustrated. They can be made of metal or of refractory material depending on the ultimate use of the products of combustion. In this case, since it is to be submerged in water, the projections 36 and 37, as well as the plenum 14, can be made of metal, which is water cooled. The projections 36 and 37 are cooled with water 64A and 64B, respectively. This water is supplied by means of pipes 66A and 66B, indicated by arrows 68. It is important to have the water level above the point at which the flame exists, so as to prevent melting of the metal. This is controlled by means of outlets 70A and 70B, so that the inflowing water maintains a selected level inside of the projections, and flows through the ports 70A and 70B in accordance with arrows 72A and 72B, respectively.

The water 76A and 76B outside of the walls 44, 45 of the plenum 14 into which the combustion chamber is submerged, is for heating and evaporation.

Figure 4:
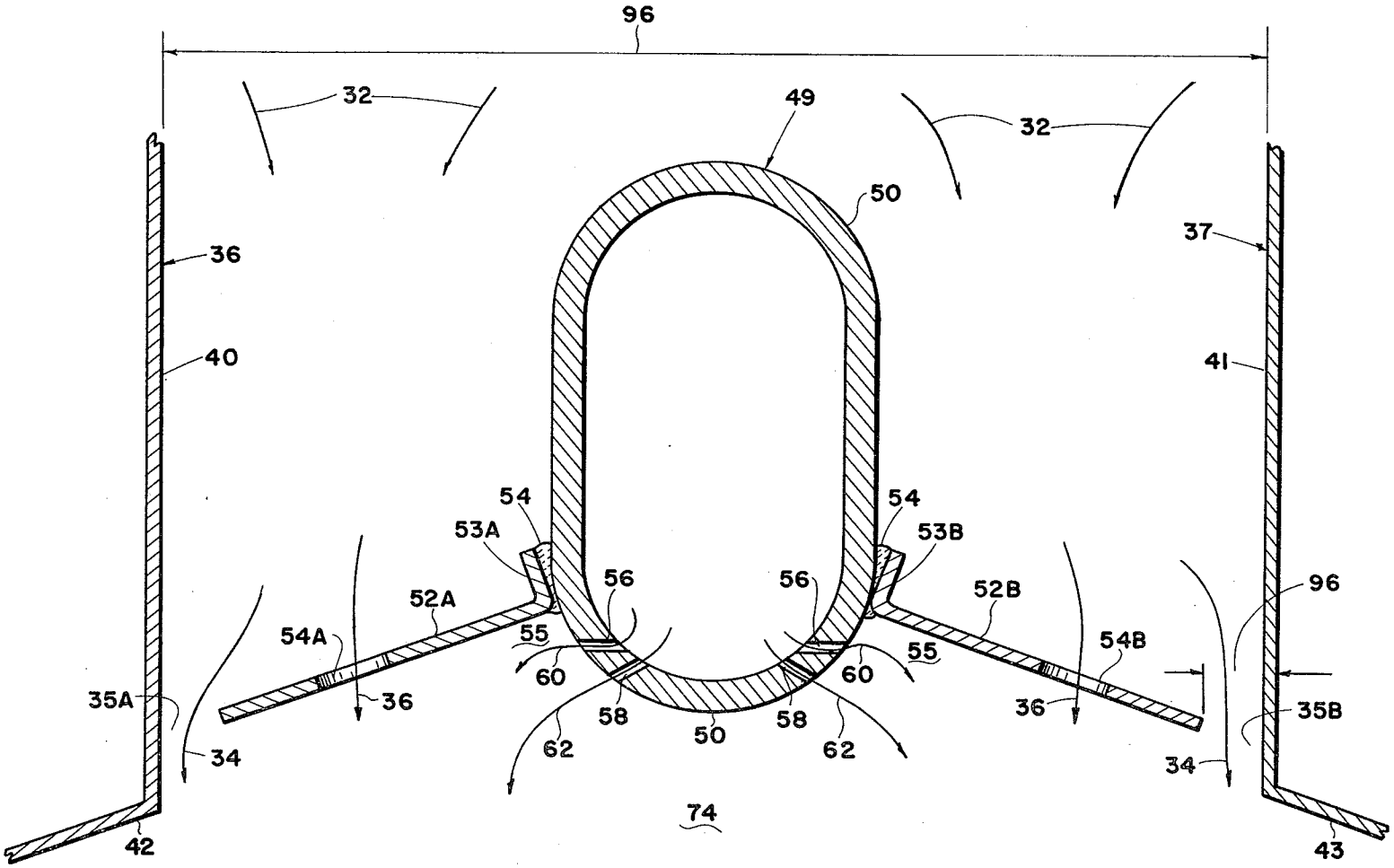
FIG. 4 is an enlarged view of the portion 4 of FIG. 2.

Referring now to FIG. 4, there is shown an enlarged portion of the burner system taken within the area 4 of FIG. 2. The walls 40 and 41 represent parts of the projections 36 and 37, respectively. The spacing between the walls 40 and 41, representing the width of the inlet to the second plenum, is represented by the dimension 96.

Figure 6:
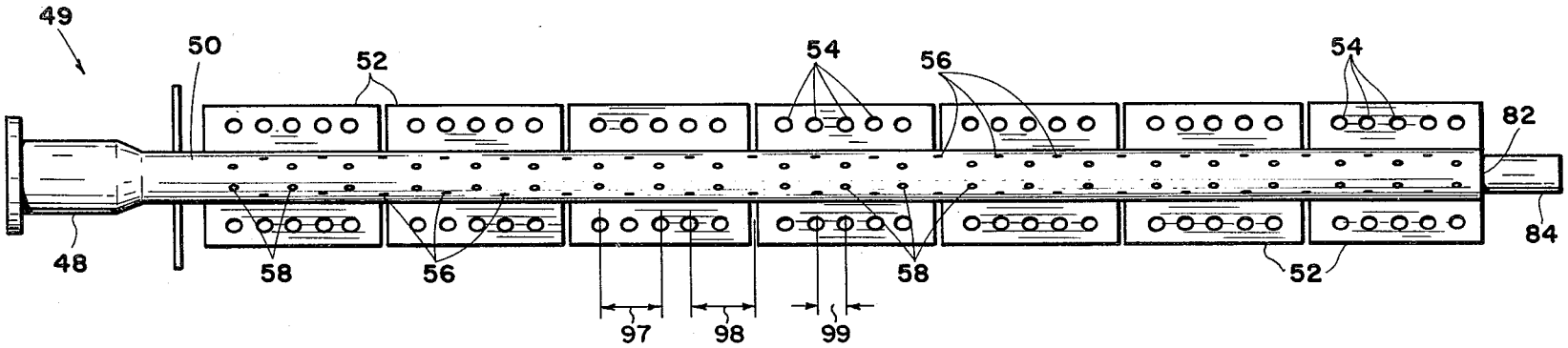
FIG. 6 represents a view from downstream of the burner assembly including the burner pipe ports and baffles.

The burner assembly 49 which will be described in detail in FIG. 6 is shown in cross-section in FIG. 4, to an enlarged scale. It comprises a flattened pipe 50 having the axis of its cross-section in a vertical plane. Pairs of air baffles 52A and 52B are attached, as by welding 54, on both sides, near the bottom of the pipe. These are slightly downwardly sloping surfaces, which cause the air flow indicated by arrows 32 to flow downwardly between the walls 50 and 41 and the pipe 50, down through the gaps 35A and 35B between the baffles 52A and 52B and the walls 40 and 41 of the inward projections. The width of these gaps is indicated by numeral 96, and is a selected value, nominally in the range of one half to five eighths inch, or more, depending on the flow rate of fuel and air required for the burner system.

Additional airflow is available in accordance with arrows 36 through a plurality of perforations 54A and 54B in the air baffles on both sides of the pipe 50. This is illustrated and will be described further in connection with FIG. 5.

There are two sets of ports drilled in spaced relation along the length of the pipe 50. A first set, indicated by numerals 58 are drilled in a downwardly and outwardly direction and provide gas flows illustrated by arrows 62. These ports are of larger cross-section than the ports 56, which are directed, more or less, horizontally outwardly, and provide smaller gas flows indicated by the arrows 60.

The airflow indicated in FIG. 2 by the arrows 28 downward into the first plenum, at pressure P1, and then downwardly in accordance with arrows 30 and 32, as illustrated in FIG. 4 as arrows 34 through the gaps 35, and the arrows 36 through the openings 54, provide high velocity flow of air into the combustion space 74 below the pipe 50.

However, under the baffles 52 in the space indicated by numerals 55, there is a relative quiet, since the high velocity air and gas flows are downstream from this space. Consequently, the gas flow 60 mixing with air from the jets 36 will provide stable flames in the spaces 55, which are unaffected by the turbulence going on downstream. These stable flames in the areas 55 will serve to continually ignite the gas flows 62 so that even though these gas jets and air jets are high velocity and are turbulently mixing they will be continually ignited and, therefore, there will be a continuous stable flame. This is so in spite of the fact that the velocity of the mixture of gas and air may be much greater than the velocity of propagation of flame in the gas mixture. Without the stable ignition flame at 55, due to the gas flow 60, the higher velocity mixture of gas and air may ignite and then go out because of the very high flow of the mixture. With the continual ignition, however, there is a continued stable flame for combustion of the gas flow 62 and airflows 34 and 36.

Referring again to FIG. 2 in the space 74 below the burner, the flow of combustion gas and combustion air will be turbulently mixed, and will be ignited by the stable flame in the areas 55, and will produce an elongated thin flat flame 78, which will flow downwardly between the walls 44 and 45 of the second plenum, in accordance with arrows 88. The products of combustion will flow in accordance with arrows 90 under the bottom edge 89 of the plenum walls 44 and 45. The flow of hot products of combustion up through the water 76A and 76B will serve to heat the water, and cool the gases. The combination of steam and cooled combustion products will gather in the space 77 above the water surface 79, and will be utilized therefrom.

Referring now briefly to FIG. 1, there is shown a plan view taken across the plane 1—1 of FIG. 2. This shows the air pipes 18 positioned in the top 20, of the first plenum 12 which is attached by flange 24 to the corresponding flange 25 of the second plenum which is supported on the plate 26 of the heat transfer system. Through the openings of the pipe the details of the burner system including the pipe 50 and the air baffles 52 are seen.

Referring now to FIG. 3, there is shown a plan view taken across the plane 3—3 of FIG. 2. This shows, in cross-hatching, the wall 22 of the first plenum 12, portions of the sloping plates 38 and 39 of the projections 36 and 37, the two longitudinal gaps 35 between the projections 38 and 39 and the baffles 52A and 52B, respectively, on either side of the gas pipe 50. Also shown are the openings 54 in the baffles 52 for additional flow of combustion air.

Figure 5:
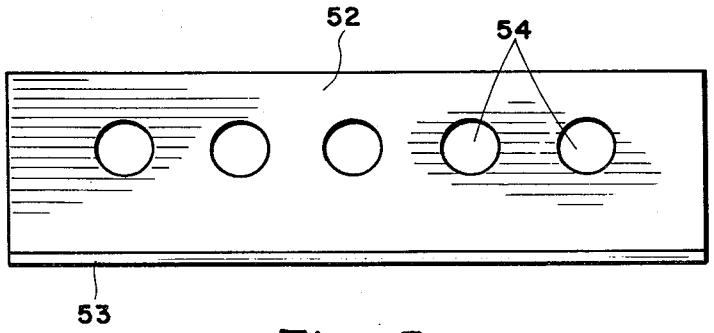
FIG. 5 represents a plan view of the air baffle units.

Referring now to FIG. 5, there is shown a plan view of one of the baffles 52 with the angular portion 53, and including a plurality of openings 54 through the broad plate of the baffle.

Referring now to FIG. 6, there is shown a view of the burner assembly 40, including the gas pipe in round form 48, which is flattened in the form 50. This extends throughout the length of the second plenum 14 and is closed off at the distal end 82. It also has an extension of smaller dimension 84 for support of the distal end of the burner assembly. The support means for the two ends of the burner assembly are not shown, since they are well known in the art. The view of the burner assembly is taken from below, looking upward. That is, from the downstream portion looking upstream.

FIG. 6 clearly shows the two sets of ports drilled in the under surface of the gas pipe. These two sets are intermingled with each other so that successive ports will be the first set and then the second set, etc.

The first set of ports 58 is composed of larger openings. The direction of the ports drilled into the lower surface of the gas pipe is directed in a downwardly and outwardly direction, for the main gas flow into the downwardly moving air streams. The second port system is of smaller openings 56, which are directed, more or less, in an outwardly direction into the space 55, immediately below the air baffles 52. The spacing of the ports along the pipe, such as 97 for the first set, and 98 for the second set are equal, and equal to 2 inches. The spacing between adjacent ports 99 is one inch.

What has been described is a gas burner system of very large gas flow capacity for producing heat flow rates of a magnitude much greater than 10,000,000 btu per hour. This design is for a gas combustion zone which has a cross-section which is long and narrow, and is also quite elongated in the flow direction, providing very rapid heat transfer to sidewalls enclosing the combustion space through which the flame passes. While this system has been described in terms of a downwardly flowing sheet of flame, such as would be ideally suited for a submerged combustion installation, this type of burner system can equally well be used with refractory walls for producing high quantities of hot products of combustion for any desired purpose.

While the invention has been described with a certain degree of particularity, it is manifest that many changes may be made in the details of the construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In a gas burner system for providing a thin flat flame for use in a long narrow combustion space, comprising, (a) a first air supply plenum for downward supply of combustion air, having a long rectangular cross-section, its length much greater than its width;

(b) a second combustion plenum contiguous and below said first plenum, having length and width of the same order of magnitude as said first plenum;

(c) a burner assembly comprising an elongated pipe being flattened to provide an oval cross-section with its long axis vertical and having air interrupting baffles extending outwardly on each side, the improvement characterized by, (d) the upstream end of said second plenum having longitudinal projections directed downwardly and inwardly from both walls, forming a narrow rectangular inlet to said second plenum;

(e) means to support said burner assembly axially in said narrow rectangular inlet, the baffles extending outwardly and downwardly, the width of said burner assembly being such as to provide longitudinal gaps on each side, between said baffles and said narrow rectangular inlet walls for passage of combustion air from said first to said second plena;

(f) a first set of gas ports drilled in said pipe, equally spaced along its length, on the downstream sdie of said pipe below said baffles and directed downstreamwardly and outwardly for the major flow of fuel gas;

(g) a second set of gas ports drilled in said pipe, equally spaced along its length, on the downstream side of said pipe below said baffles and above said first ports directed substantially horizontally outwardly into the spaces behind said baffles, for a minor flow of fuel gas; the longitudinal spacings between said first ports being equal to the spacings between said second ports, said first ports longitudinally positioned between said second ports;

whereby the flow of gas through said second set of ports will provide a stable flame sheltered by said baffles from the turbulent flow of air and fuel gas; which will continuously ignite the turbulent mixture of fuel gas, flowing through said first set of ports and air flowing through said gaps in the second plenum, downstream from said burner assembly.

2. The apparatus as in claim 1, the further improvement characterized by projections and said walls of said second plenum being water-cooled metal.

3. The improvement in claim 2, further characterized by the bottom end of said second plenum, or combustion chamber, being open and immersed under water.

* * * * *